US009129788B2

(12) United States Patent
Choi et al.

(10) Patent No.: US 9,129,788 B2
(45) Date of Patent: Sep. 8, 2015

(54) LENS FOR ELECTRON CAPTURE DISSOCIATION, FOURIER TRANSFORM ION CYCLOTRON RESONANCE MASS SPECTROMETER COMPRISING THE SAME AND METHOD FOR IMPROVING SIGNAL OF FOURIER TRANSFORM ION CYCLOTRON RESONANCE MASS SPECTROMETER

(71) Applicant: KOREA BASIC SCIENCE INSTITUTE, Daejeon (KR)

(72) Inventors: Myoung Choul Choi, Chungcheongbuk-do (KR); Sang Hwan Choi, Daejeon (KR); Se Gyu Lee, Chungcheongbuk-do (KR); Jeong Min Lee, Daejeon (KR)

(73) Assignee: Korea Basic Science Institute, Daejeon (KR)

( * ) Notice: Subject to any disclaimer, the term of this patent is extended or adjusted under 35 U.S.C. 154(b) by 0 days.

(21) Appl. No.: 14/351,524

(22) PCT Filed: Oct. 10, 2012

(86) PCT No.: PCT/KR2012/008183

§ 371 (c)(1),
(2) Date: Apr. 11, 2014

(87) PCT Pub. No.: WO2013/055085

PCT Pub. Date: Apr. 18, 2013

(65) Prior Publication Data

US 2014/0284470 A1 Sep. 25, 2014

(30) Foreign Application Priority Data

Oct. 13, 2011 (KR) ..... 10-2011-0104494

(51) Int. Cl.
*H01J 49/00* (2006.01)
*H01J 49/06* (2006.01)

(52) U.S. Cl.
CPC ..... *H01J 49/067* (2013.01); *H01J 49/0027* (2013.01); *H01J 49/0054* (2013.01); *H01J 49/062* (2013.01)

(58) Field of Classification Search
CPC ..... H01J 25/00; H01J 25/12; H01J 25/14; H01J 25/16; H01J 25/18; H01J 25/30; H01J 25/5064; H01J 25/66; H01J 27/205; H01J 27/20; H01J 27/0054; H01J 49/149
USPC ..... 250/281, 282, 283, 285, 286, 288, 290, 250/291
See application file for complete search history.

(56) References Cited

U.S. PATENT DOCUMENTS 6,380,684 B1 * 4/2002 Li et al. ..... 315/111.21
7,696,476 B2 4/2010 Kim et al.

(Continued)

FOREIGN PATENT DOCUMENTS

JP 2006-234782 A 9/2006
JP 2010-170754 A 8/2010
KR 10-0790532 B1 1/2008

OTHER PUBLICATIONS

Tsybin et al., Impact of Ion Magnetron Motion on Electron Capture Dissociation Fourier Transform Ion Cyclotron Resonance Mass Spectrometry, Feb. 7, 2006, International Journal of Mass Spectrometry, 255-256, pp. 144-149.*

(Continued)

*Primary Examiner* — Michael Logie
*Assistant Examiner* — Jason McCormack
(74) *Attorney, Agent, or Firm* — Fenwick & West LLP

(57) ABSTRACT

A lens for electron capture dissociation may include: a first electrode and a second electrode spaced apart from each other and arranged along a first direction; and a third electrode and a fourth electrode spaced apart from each other and arranged along a second direction perpendicular to the first direction. The first electrode and the second electrode may be disposed in a space in which a magnetic field is formed in the first direction and trap electrons. The third electrode and the fourth electrode may be in the form of a flat plate and may apply an electric field to the trapped electrons in the second direction.

3 Claims, 2 Drawing Sheets

(56) References Cited

U.S. PATENT DOCUMENTS

| | | | | |
|---|---|---|---|---|
| 2003/0183760 | A1 | 10/2003 | Tsybin et al. | |
| 2004/0026628 | A1* | 2/2004 | Schweikhard et al. | 250/423 R |
| 2005/0178955 | A1* | 8/2005 | Baba et al. | 250/281 |
| 2005/0263695 | A1* | 12/2005 | Syka | 250/291 |
| 2006/0169892 | A1* | 8/2006 | Baba et al. | 250/292 |

OTHER PUBLICATIONS

PCT International Search Report PCT/KR2012/008183, Feb. 20, 2013, 3 Pages.

Baba, T., et al., "Electron Capture Dissociation in a Radio Frequency Ion Trap," Analytical Chemistry, Aug. 1, 2004, pp. 4263-4266, vol. 76, No. 15.

Baba, T. et al., "Electron Capture Dissociation in a Radio Frequency Ion Trap," *Analytical Chemistry*, Aug. 1, 2004, pp. 4263-4266, vol. 76, No. 15.

PCT International Search Report and Written Opinion, PCT Application No. PCT/KR2012/008183, Feb. 20, 2013, six pages.

* cited by examiner

LENS FOR ELECTRON CAPTURE DISSOCIATION, FOURIER TRANSFORM ION CYCLOTRON RESONANCE MASS SPECTROMETER COMPRISING THE SAME AND METHOD FOR IMPROVING SIGNAL OF FOURIER TRANSFORM ION CYCLOTRON RESONANCE MASS SPECTROMETER

TECHNICAL FIELD

Embodiments relate to a lens for electron capture dissociation, a Fourier transform ion cyclotron resonance mass spectrometer (FT-ICR MS) including the same and a method for improving signal of an FT-ICR MS.

BACKGROUND ART

A Fourier transform ion cyclotron resonance mass spectrometer (FT-ICR MS) is an apparatus for elucidating molecular structure by measuring the mass of molecular ions and fragment ions, and has become a basic standard for high-resolution broadband mass spectrometry. The FT-ICR MS is configured to measure the mass of ions in an ion cyclotron resonance (ICR) trap consisting of a cylindrical trap electrode, an activation electrode, a measurement electrode, etc. For example, Korean Patent No. 10-0790532 titled "A method for improving Fourier transform ion cyclotron resonance mass spectrometer signal" discloses a conventional FT-ICR MS.

In the ICR trap, ions exhibit cyclotron motions, including cyclotron rotation, magnetron rotation and axial trapping oscillation. The cyclotron rotation results from the Lorentz force applied on charged ions moving in a static magnetic field. And, the magnetron rotation is induced by the radial electric field gradient formed by an electrostatic trapping voltage in the ICR trap. Further, the ions oscillate linearly along the axial direction of the magnetic field at the trapping oscillation frequency. The FT-ICR MS can measure the mass of ions based on these cyclotron motions of the ions occurring in the ICR trap.

Meanwhile, electron capture dissociation (ECD) refers to a phenomenon in which low energy electrons are introduced to molecular ions to be analyzed to break specific bonds in the FT-ICR MS. ECD is a method of fragmenting ions, which is one of the important processes in elucidation of molecular structure. For example, a process wherein a molecular ion formed from binding of n hydrogen atoms (H) to an atom (M) interacts with an electron to form a fragment ion can be expressed by the following Equation 1.

$$[M+nH]^{m+}+e^{-}\rightarrow[[M+nH]^{(n-1)+}]^{*} \quad \text{[Equation 1]}$$

To induce ECD, electrons are emitted from a cathode of an ECD gun and the emitted electrons are introduced into the ICR trap using, for example, a lens. Fragment ions can be generated in the ICR trap through interaction between the molecular ions and electrons according to Equation 1. Unlike other conventional techniques, ECD can produce fragment ions and is a very important method, for example, in post-translational modification.

However, ECD has the problem that the production efficiency of fragment ions is low. In the FT-ICR MS, the ions are captured using a very high and constant magnetic field for measurement of mass. Under such high magnetic field, electrons are also captured in the magnetic field as the ions are in the magnetic field. Accordingly, an environment is formed in which the electrons are very difficult to move in a direction perpendicular to the magnetic field. ECD occurs when the molecular ions interact with electrons, but, under such an environment, it is not easy for the ions to interact with electrons even when they are close to each other. Due to this problem, the production efficiency of fragment ions using ECD is low.

DISCLOSURE OF INVENTION

Technical Problem

According to an aspect, the present disclosure is directed to providing a lens for electron capture dissociation (ECD) configured to increase the probability of interaction between molecular ions and electrons in ECD by increasing the collision cross section, a Fourier transform ion cyclotron resonance mass spectrometer (FT-ICR MS) including the same, and a method for improving signal of an FT-ICR MS.

Solution to Problem

A lens for electron capture dissociation according to an exemplary embodiment may include: a first electrode and a second electrode spaced apart from each other and arranged along a first direction; and a third electrode and a fourth electrode spaced apart from each other and arranged along a second direction perpendicular to the first direction. The first electrode and the second electrode may be disposed in a space in which a magnetic field is formed in the first direction and trap electrons. And, the third electrode and the fourth electrode may be in the form of a flat plate and apply an electric field to the trapped electrons in the second direction.

A Fourier transform ion cyclotron resonance mass spectrometer (FT-ICR MS) according to an exemplary embodiment may include: a magnet forming a magnetic field in a first direction; an ion cyclotron resonance trap trapping target ions using the magnetic field in the first direction; an electron capture dissociation gun emitting electrons to a space in which the magnetic field is formed in the first direction; and a lens trapping the electrons emitted from the electron capture dissociation gun and applying an electric field to the trapped electrons in a second direction perpendicular to the first direction.

A method for improving signal of an FT-ICR MS according to an exemplary embodiment may include: emitting electrons to a space in which a magnetic field is formed in a first direction; trapping the emitted electrons using a first electrode and a second electrode spaced apart from each other and arranged along the first direction and a third electrode and a fourth electrode in the form of a flat plate spaced apart from each other and arranged along a second direction perpendicular to the first direction; and applying an electric field to the trapped electrons in the second direction using the third electrode and the fourth electrode.

Advantageous Effects of Invention

A lens for electron chapture dissociation (ECD), a Fourier transform ion cyclotron resonance mass spectrometer (FT-ICR MS) comprising the same and a method for improving signal of an FT-ICR MS according to an aspect of the present disclosure may disperse the electrons emitted from an ECD gun in a direction perpendicular to a magnetic field by applying an electric field to the electrons in a direction perpendicular to the magnetic field. As a result, the collision cross section of molecular ions and the electrons can be increased and, thus, the probability of interaction between the molecular ions and the electrons can be increased. Accordingly, the signals of the ECD fragment ions in the FT-ICR MS can be improved.

BRIEF DESCRIPTION OF DRAWINGS

The above and other objects, features and advantages of the present disclosure will become apparent from the following description of certain exemplary embodiments given in conjunction with the accompanying drawings, in which.

MODE FOR THE INVENTION

The advantages, features and aspects of the present disclosure will become apparent from the following description of the embodiments with reference to the accompanying drawings, which is set forth hereinafter. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. The terminology used herein is for the purpose of describing particular embodiments only and is not intended to be limiting of the example embodiments. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Hereinafter, exemplary embodiments will be described in detail with reference to the accompanying drawings.

Figure 1:
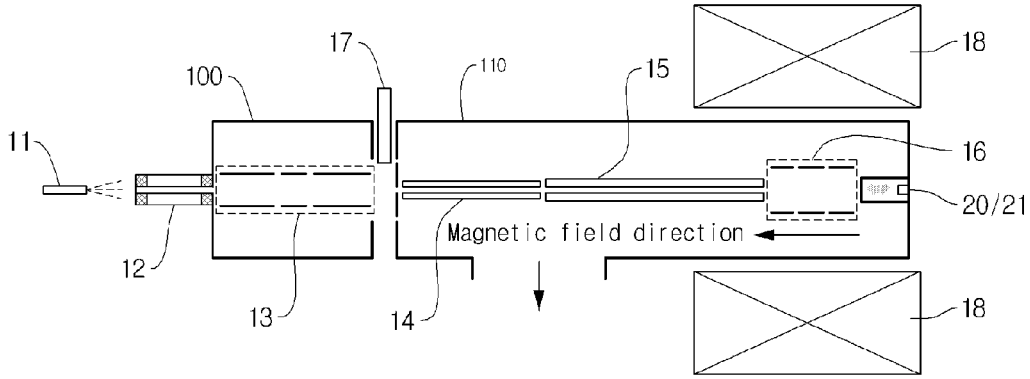
FIG. 1 schematically shows a Fourier transform ion cyclotron resonance mass spectrometer according to an exemplary embodiment.

FIG. 1 schematically shows a Fourier transform ion cyclotron resonance mass spectrometer (FT-ICR MS) according to an exemplary embodiment. When describing the FT-ICR MS according to embodiments, detailed description about the matters that can be easily understood by those skilled in the art from the existing FT-ICR MS will be omitted to avoid unnecessary obscurity.

Referring to FIG. 1, target ions generated from an ionization source 11 may pass through one or more RF ion guides 12, 14, 15, an einzel lens 13, etc. and reach an ion cyclotron resonance (ICR) trap 16. For example, the ion guide 12 may be a hexapole ion guide, and the ion guides 14, 15 may be octopole ion guides. However, this is only an exemplary configuration of an FT-ICR MS, and the number or configuration of the ion guides is not particularly limited. A space through which the ions travel may be divided by one or more pressure-controllable chambers 100, 110. And, a gate valve 17 may be provided between the chambers 100, 110.

Also, the FT-ICR MS may comprise a magnet 18 for applying a magnetic field to the ICR trap 16. For example, the magnet 18 may be disposed to enclose the chamber 110 located in the ICR trap 16. The target ions may be trapped in the ICR trap 16 using the magnetic field applied by the magnet 18. For example, the magnet 18 may generate a magnetic field of about 15 tesla, although not being limited thereto. The target ions refer to the target molecules to be made into fragment ions by means of electron capture dissociation (ECD) and may be charged ions that can be trapped by a magnetic field.

The FT-ICR MS may further comprise an ECD gun 20 and a lens 21. By reacting electrons emitted from the ECD gun 20 with the target ions trapped in the ICR trap 16, fragment ions may be generated from the target ions. For this purpose, the ECD gun 20 may generate and emit thermal electrons of low energy. The lens 21 may increase the collision cross section of the electrons and the target ions by trapping the electrons emitted from the ECD gun 20 and inducing drifting motion in a direction perpendicular to the magnetic field using an electric field.

Figure 2:
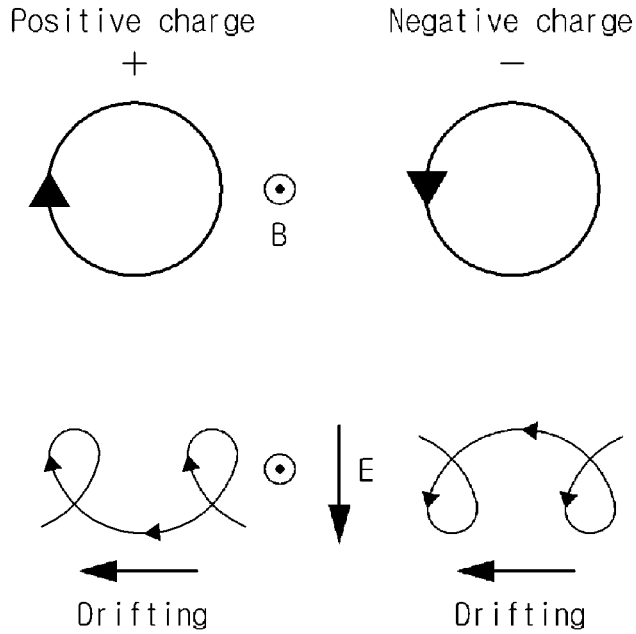
FIG. 2 schematically shows the movement of an electron in a direction perpendicular to a magnetic field in a lens for electron capture dissociation (ECD) according to an exemplary embodiment.

FIG. 2 schematically shows the movement of an electron in a direction perpendicular to a magnetic field in a lens for ECD according to an exemplary embodiment.

Referring to FIG. 2, in a magnetic field B and an electric field E which are perpendicular to each other, a force determined by a vector product E×B is exerted on a charged particle. The direction of the force applied to the charged particle is opposite when the charge is positive and when it is negative. As shown in top of FIG. 2, a positive charge and a negative charge move in a circle, in opposite directions. In the figure, the magnetic field B is directed perpendicularly out of the plane and the electric field E is directed downward. In this case, a drift force is applied to both the positive and negative charges in a direction determined by the vector product E×B, which is perpendicular to both the magnetic field B and the electric field E, i.e. in the leftward direction in the figure. As a result, the motion of the positive and negative charges is changed as shown in bottom of FIG. 2.

In the FT-ICR MS, target ions are captured using a high magnetic field. Under the high magnetic field, electrons are also captured in the magnetic field. Accordingly, by applying an electric field to the electrons emitted from the ECD gun in a direction perpendicular to the magnetic field, the drifting motion of the electrons in the direction perpendicular to the magnetic field may be induced. As a result, the collision cross section of the target ions and the electrons can be increased and, thus, the probability of interaction between the target ions and the electrons can be increased. Accordingly, the signals of the ECD fragment ions in the FT-ICR MS can be improved.

Figure 3A:
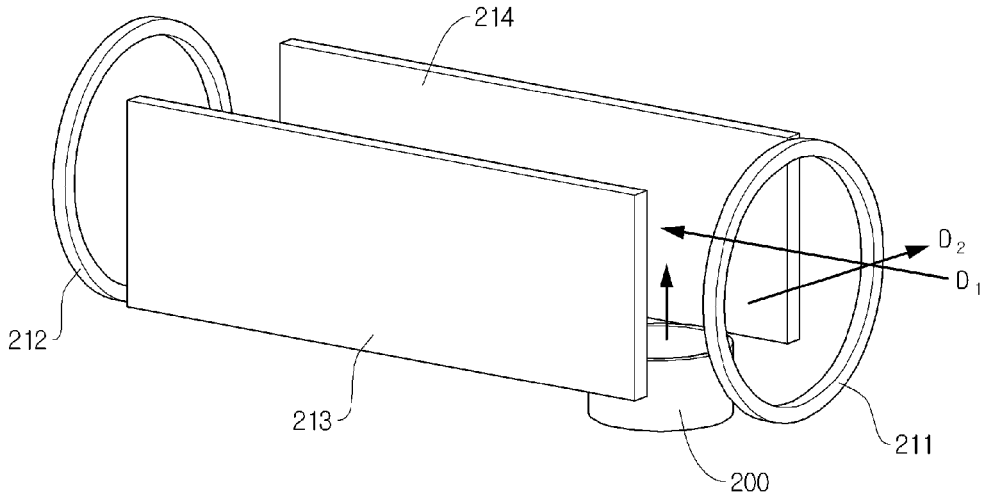
FIG. 3*a* schematically shows an ECD gun mounted to a lens for ECD in a direction perpendicular to that of a magnetic field according to an exemplary embodiment.

FIG. 3*a* schematically shows a lens for ECD according to an exemplary embodiment, in which an ECD gun is mounted to the lens for ECD such that electrons are emitted from the ECD gun in a direction perpendicular to that of a magnetic field.

Referring to FIG. 3*a*, a lens for ECD may comprise a first electrode 211, second electrode 212, third electrode 213 and a fourth electrode 214. The first electrode 211 and the second electrode 212 may be arranged along a first direction D1 to be spaced apart from each other. And, the third electrode 213 and the fourth electrode 214 may be arranged along a second direction D2 to be spaced apart from each other. The first direction D1 and the second direction D2 may be perpendicular to each other. The first to fourth electrodes 211-214 may be disposed in a space of an FT-ICR MS in which a magnetic field is formed in the first direction D1.

An ECD gun may emit electrons to a space enclosed by the first to fourth electrodes 211-214. For example, the ECD gun may be disposed such that the electron-emitting portion of a cathode emitter 200 of the ECD gun faces the space enclosed by the first to fourth electrodes 211-214. However, the position and direction of the ECD gun may be set arbitrarily otherwise as long as the ions can move toward the center of the space enclosed by the first to fourth electrodes 211-214 due to the drifting motion by the lens. Due to this feature, the ECD gun may be prevented from blocking a laser beam for infrared multiphoton dissociation (IRMPD) inputted from a location opposite to the electron emission. Accordingly, the two fragmentation techniques can be employed together.

The first to fourth electrodes 211-214 may function as a Penning trap trapping the electrons emitted from the ECD gun using an electric field and a magnetic field. For this purpose, a power suitable to trap the electrons may be applied to each of the first to fourth electrodes 211-214. The first to fourth electrodes 211-214 may trap the electrons in the space enclosed by the first to fourth electrodes 211-214 using the power applied thereto and the magnetic field in the first direction D1.

The third electrode 213 and the fourth electrode 214 may apply an electric field to the trapped electrons in a direction perpendicular to that of the magnetic field. In this embodiment, the magnetic field is formed in the first direction D1 and the third electrode 213 and the fourth electrode 214 are configured to apply the electric field in the second direction D2 perpendicular to the first direction D1. For this purpose, the third electrode 213 and the fourth electrode 214 may be in the form of a flat plate. Meanwhile, each of the first electrode 211 and the second electrode 212 may be a lens having a hole. For example, each of the first electrode 211 and the second electrode 212 may be in the form of a ring. However, this is only exemplary, and the shape of the first to fourth electrodes 211-214 is not limited to those described in this disclosure or shown in the attached drawings.

The electrons trapped in the Penning trap consisting of the first to fourth electrodes 211-214 reciprocate between the first electrode 211 and the second electrode 212 while exhibiting a cyclotron motion under the influence of the electric field and the magnetic field. When the electric field is applied by the third electrode 213 and the fourth electrode 214 in the second direction D2 perpendicular to that of the magnetic field, drifting motion of the electrons is induced in a direction determined by the magnetic field in the first direction D1 and the electric field in the second direction D2 (i.e., vertical direction in FIG. 3*a*). As a result, the electrons reciprocating between the first electrode 211 and the second electrode 212 move gradually in the direction perpendicular to the first direction D1.

As the electrons are emitted continuously from the cathode emitter 200, the overall cross section of the electrons reciprocating in the ECD lens increases gradually in the vertical direction. After a predetermined time passes, the electrons trapped in the ECD lens may be emitted to the ICR trap in which target ions are trapped by adjusting the voltage of the electrode closer to the ICR trap among the first electrode 211 and the second electrode 212. Since the cross section of the electrons is increased in the direction perpendicular to that of the magnetic field, fragment ions can be generated easily via interaction because the collision cross section of the target ions trapped in the ICR trap and the electrons is large.

Figure 3B:
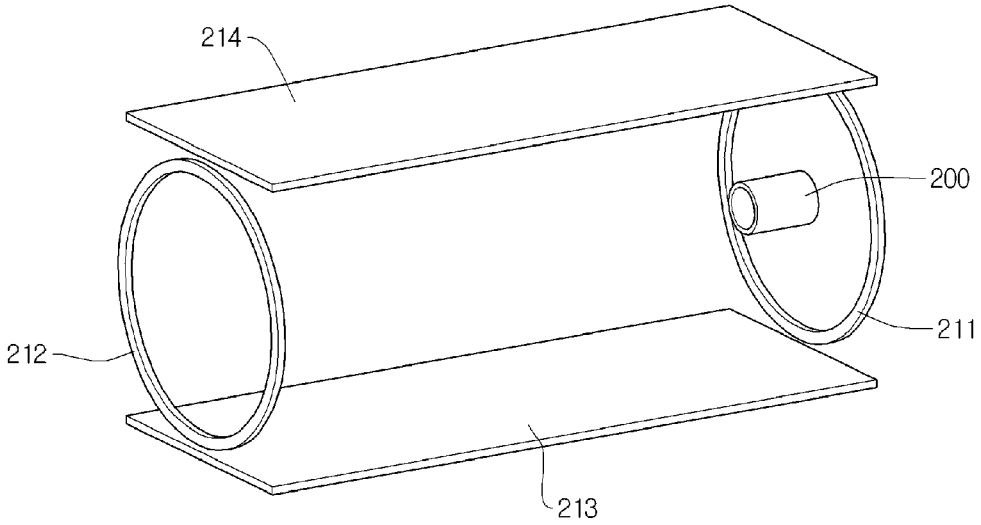
FIG. 3*b* schematically shows an ECD gun mounted to a lens for ECD in a direction parallel to that of a magnetic field according to an exemplary embodiment.

FIG. 3*b* schematically shows an ECD gun mounted to a lens for ECD in a direction parallel to that of a magnetic field according to an exemplary embodiment.

Differently from the foregoing embodiment described with reference to FIG. 3*a* wherein the cathode emitter 200 of the ECD gun emits the electrons in the direction perpendicular to that of the magnetic field (D1), the cathode emitter 200 of the ECD gun may emit the electrons in a direction parallel to that of the magnetic field (D1) in the embodiment shown in FIG. 3*b*. For example, the cathode emitter 200 may be located at the center of the first electrode 211. However, the arrangements shown in FIGS. 3*a* and 3*b* are only exemplary. In other embodiments, the ECD gun may emit the electrons toward the ECD lens with a different angle with respect to the magnetic field.

While the present disclosure has been described with respect to the specific embodiments, it will be apparent to those skilled in the art that various changes and modifications may be made without departing from the spirit and scope of the disclosure as defined in the following claims.

INDUSTRIAL APPLICABILITY

Embodiments relate to a lens for electron capture dissociation, a Fourier transform ion cyclotron resonance mass spectrometer (FT-ICR MS) including the same and a method for improving signal of an FT-ICR MS.

The invention claimed is:

1. A Fourier transform ion cyclotron resonance mass spectrometer comprising:

a magnet forming a magnetic field in a first direction;

an ion cyclotron resonance trap trapping target ions using the magnetic field in the first direction;

an electron capture dissociation gun emitting electrons to a space in which the magnetic field is formed in the first direction; and a lens disposed between the electron capture dissociation gun and the ion cyclotron resonance trap, the lens configured to trap the electrons emitted from the electron capture dissociation gun, apply an electric field to the trapped electrons in a second direction perpendicular to the first direction so as to induce drifting motion of the electrons in the second direction, and emit the electrons toward the ion cyclotron resonance trap after applying the electric field to the trapped electrons, wherein the lens comprises:

a first electrode and a second electrode spaced apart from each other and arranged along the first direction; and a third electrode and a fourth electrode spaced apart from each other and arranged along the second direction, the third electrode and the fourth electrode being in the form of a flat plate and applying the electric field to the trapped electrons in the second direction;

wherein the first electrode, the second electrode, the third electrode, and the fourth electrode enclose the space in which the magnetic field is formed.

2. The Fourier transform ion cyclotron resonance mass spectrometer according to claim 1, wherein the electron capture dissociation gun is disposed to emit the electrons in a direction parallel to the first direction.

3. The Fourier transform ion cyclotron resonance mass spectrometer according to claim 1, wherein the electron capture dissociation gun is disposed to emit the electrons in a direction perpendicular to the first direction.

* * * * *